United States Patent [19]

Liebel

[11] Patent Number: 4,771,893

[45] Date of Patent: Sep. 20, 1988

[54] CORRUGATED PAPER CORNER POST

[75] Inventor: Henry L. Liebel, Cincinnati, Ohio

[73] Assignee: Shippers Paper Products Company, Loveland, Ohio

[21] Appl. No.: 49,390

[22] Filed: May 13, 1987

[51] Int. Cl.[4] ..... B65D 81/02

[52] U.S. Cl. ..... 206/586; 206/326; 220/448; 229/DIG. 1

[58] Field of Search ..... 206/586, 453, 326; 229/DIG. 1; 220/447, 445, 448

[56] References Cited

U.S. PATENT DOCUMENTS

| | | | |
|---|---|---|---|
| 2,068,771 | 1/1937 | Sherman . | |
| 2,160,221 | 5/1939 | Masters et al. . | |
| 2,196,157 | 4/1940 | White . | |
| 2,271,265 | 1/1942 | Kirby | 206/453 X |
| 2,514,833 | 7/1950 | Bergeron . | |
| 3,072,313 | 1/1963 | Svendsen . | |
| 3,133,687 | 5/1964 | Fremion . | |
| 3,337,111 | 8/1967 | Petriekis et al. . | |
| 3,433,354 | 3/1969 | Liebel . | |
| 3,536,245 | 10/1970 | Palmer . | |
| 3,556,529 | 1/1971 | Noriega . | |
| 3,708,101 | 1/1973 | McDanield . | |
| 3,734,389 | 5/1973 | Brown . | |
| 4,027,817 | 6/1977 | Fremion | 206/586 |
| 4,120,441 | 10/1978 | Hurley . | |
| 4,292,901 | 10/1981 | Cox | 206/586 X |
| 4,399,915 | 8/1983 | Sorenson | 206/586 |

FOREIGN PATENT DOCUMENTS

| | | |
|---|---|---|
| 2080767 | 2/1982 | United Kingdom . |

*Primary Examiner*—Stephen Marcus
*Assistant Examiner*—Bryon Gehman
*Attorney, Agent, or Firm*—Wood, Herron & Evans

[57] ABSTRACT

An integral, elongated corner post for cushioning and protecting the edges of a packaged article. The corner post includes a core of single-face corrugated wrapped with one or more layers of a second sheet single-face corrugated with the flutes thereof being at a 90° angle to the flutes of the core. The single-face wrapping encloses the core including its lengthwise edges with the flutes thereof being adhered to the face and the flutes of the single-face core. The outer surface of the corner post is smooth with rounded lengthwise edges providing cushioning of the edges of the packaged article.

4 Claims, 3 Drawing Sheets

CORRUGATED PAPER CORNER POST

BACKGROUND OF THE INVENTION

This invention relates to corner posts used in the packaging of articles and, particularly, to corner posts applied, e.g., as vertical corner posts such as for insertion into the corners of a straight-sided flexible container adapted for cushioning the straight corners and edges of packaged articles along the full height thereof and also adapted to permit the stacking of the packaged articles on each other without damaging the container or the article contained therein, and horizontal corner posts permitting pick up and movement of packed articles by a squeeze truck without sideways crushing of the articles.

In packaging a number of articles including heavy articles such as refrigerators, television sets, stoves, air conditioners and washing machines and dryers, it is customary to package them in relatively lightweight containers formed of paperboard or corrugated or to envelop them in a plastic film such as by shrink or stretch wrap techniques. The article is located and cushioned within the container or film by corner posts which typically are one or more pieces of cardboard folded to a 90° angle and inserted along the edges of the article and the corners of the containers or film. Such corner posts are used to provide cushioning to protect the corners of the packed article from damage such as scratching and denting during shipping and handling.

A number of corner posts are known to the art. Representative of such designs are U.S. Pat. Nos. 2,068,771; 2,160,221; 2,196,157; 2,514,833; 3,556,529; 3,133,687; 3,337,111; 3,536,245; 3,072,313; 3,433,354; 3,708,101; 3,734,389; 4,120,441; and G.B. 2,080,767. These prior art corner posts, however, all have one or more of the following disadvantages. Although some provide relatively good cushioning, they do not provide a load bearing capacity in the vertical direction which would permit the vertical stacking of loaded containers, or, if they do, they are of substantial bulk and thus require large amounts of materials, are heavy, and take up space. For protectors not providing vertical load bearing capacity, when stacking of such containers is attempted, the weight of the upper container crushes the underlying containers by bending or buckling the walls of the container which bear the stacking load. Others which attempt to provide such vertical load bearing capacity in turn do not always provide sufficient cushioning and/or are relatively complex in design and expensive to manufacture. Since the packaging materials do not add value to the product itself, the costs of such materials are an important consideration to the manufacturer who uses such posts in shipping finished goods. Finally, some designs are subject to crushing by lateral forces supplied to the container and by shifting movement of the article within the container detracting from the cushioning protection for the edge and corners of the article.

SUMMARY OF THE INVENTION

The present invention provides an integral, elongated corner post for cushioning and protecting the edges of a packaged article which provides excellent vertical load bearing or stacking strength and excellent horizontal load bearing strength as the case may be, good cushioning, good impact resistance, substantial thickness for spacing the outer surface of the packaged article from the side walls of the container or film but with a minimum of material, is lightweight, is clean with no rough edges, and is simple in design and relatively economical to produce.

In one presently preferred form of the invention, the corner post of the present invention includes a core formed of single-face corrugated having a smooth facing sheet and a corrugated or fluted sheet glued thereto. A second sheet of single-face corrugated is wrapped about this core at least one time with the flutes thereof being adhered to the surfaces of the underlying core and lying perpendicular to the flutes of the core. This wrapping includes the vertical edges of the core giving the corner protector desired smooth, rounded edges. Moreover, the corner protector's outer surface comprises the plain paper face of the second single-face corrugated giving the product a desired continuous, smooth outer surface. The core is scored to permit its bending to a 90° angle; and, when bent, the apex of the angle is smooth and rounded. The perpendicularity of the three layers of flutes and the rounded edges and apex provide the corner post with excellent load bearing strength and minimum warp. The corner post provides maximum cushioning and cushioning space for the amount of material used, is lightweight, and has no rough edges.

The corner protector of the present invention, however, is relatively simple in design and quite economical to produce.

DETAILED DESCRIPTION OF THE INVENTION

Figure 1:
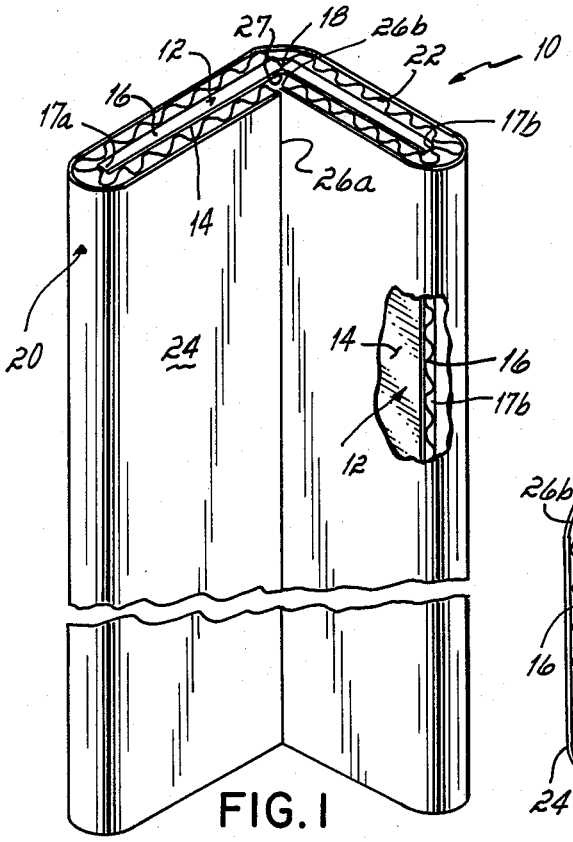
FIG. 1 is a perspective view of the corner post of the present invention with a section removed.

Referring first to FIG. 1, the corner post 10 of the present invention includes a core 12 of single face corrugated. The core may be of any desired thickness, however, it has been found that about $\frac{1}{8}''$ to $\frac{1}{4}''$ thick or somewhat greater thickness core is suitable. This core is made up of a smooth paper facing sheet 14 to which is glued a corrugated or fluted sheet 16 and includes a pair of lengthwise edges 17*a*, 17*b*. The flutes of the core lie at a 90° angle to the lengthwise edges 17*a*, 17*b*. The fluted sheet 16 is scored along a line 18 to permit bending of the core into an angle.

Figure 2:
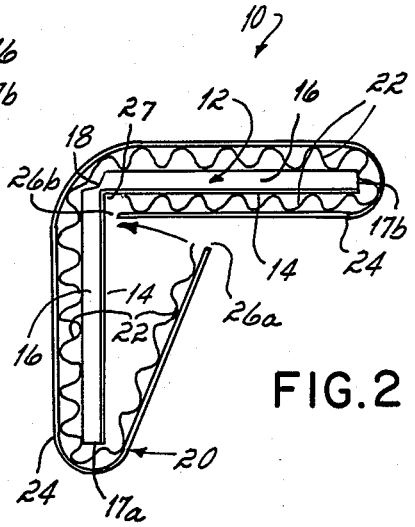
FIG. 2 is a top view of the corner post shown in FIG. 1 illustrating its method of construction, i.e., wrapping of the core with the single-face corrugated cardboard.

The core 12 is wrapped with an outer wrapping of single-face corrugated 20. The single-face corrugated 20 consists of one side of corrugated or fluted paper 22 adhered to an uncorrugated or plain sheet 24. The wrapping completely surrounds the core including the lengthwise edges 17*a*, 17*b* thereof giving those edges a desirable rounded and cushioned configuration. As shown in FIG. 1, the flutes 22 of the wrapping 20 run in a direction parallel to edges 17*a*, 17*b*; and, as shown in FIG. 2, are perpendicular to the flutes 16 of the core 12. The flutes 22 face inwardly to the core 12 and are glued thereto.

Referring in addition to FIG. 2, it may be seen that the wrapping is begun at the middle of the core 12 and continued to envelope the core 12 such that when the core is bent to form a 90° angle the ends 26*a*, *b* of the wrap 20 meet at the interior angle 27. In one successfully operable embodiment, the core had a thickness of about 5/32" and was wrapped with a like layer of single-face corrugated to give an overall thickness of about ½".

The corner post has excellent strength in its lengthwise direction due to the presence of the angular core 12 and outer sheet 20 and the flutes thereof being at right angles to each other. The smooth, rounded apex also contributes to increased strength. The opposed flutes also provide for a minimum of warp of the corner post. The multiple layers of single-face corrugated 14 and 22 provide cushioning between the edges of the article and the container containing that article. Moreover, they provide good resistance to impact. The multiple layers of single-face corrugated provide a corner post having a substantial thickness thus spacing the outer surface of the protector from the outer surface of the article a substantial degree with a minimum of material and weight. Again, this is useful in preventing damage to the sides of the article by puncturing through the side walls of the container. If desired, multiple wraps of sheet 20 may be made to provide increased cushioning.

The corner post thus has excellent vertical stack strength when used in an environment where the posts are placed along the vertical side edges of the packaged articles. In some applications, the packaged articles are subject to sideways compressive forces as, for example, when a squeeze truck is used to pick up and move the packaged articles by squeezing them between a pair of side platens. In this application, placing the corner post in a horizontal direction provides excellent resistance to the crushing forces of the squeeze truck thereby protecting the packaged articles.

For any application, the corner post may be shipped in either a preformed, rigid angular configuration, as shown in FIG. 2, or in a flat or knocked down condition with the user then bending it to its angular configuration before use.

Figure 3:
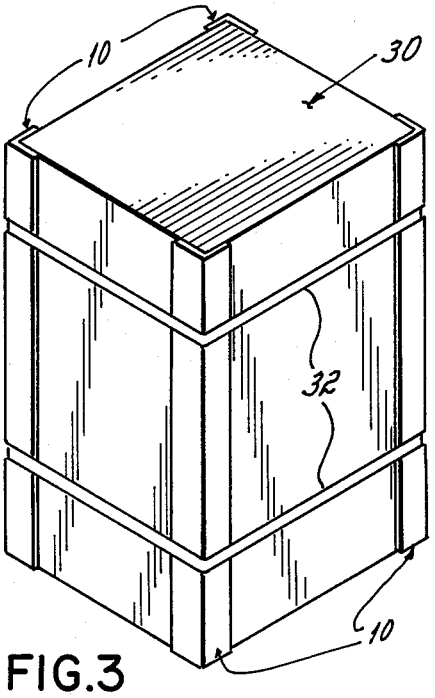
FIG. 3 is a perspective view showing one application of the corner post of the present invention.
Figure 4:
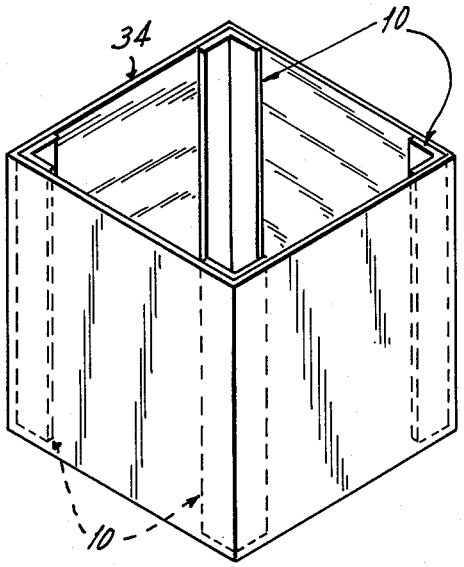
FIG. 4 is a perspective view showing another application of the corner post of the present invention.
Figure 5:
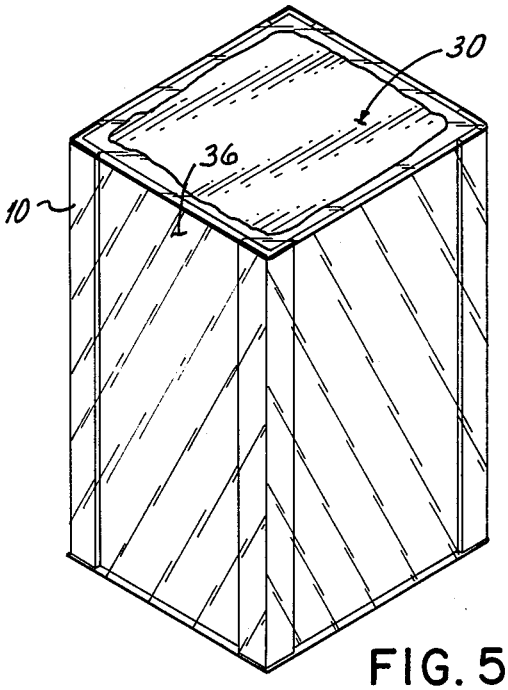
FIG. 5 is a perspective view showing another application of the corner post of the present invention.

Referring now to FIGS. 3, 4 and 5, three environments are illustrated showing the use of the corner post of the present invention. In FIG. 3, the article 30 is shipped with corner posts 10 at its four vertical edges being retained thereby by upper and lower bands or straps 32 surrounding the article 30. As noted, the rounded edges of the corner post 10 and the strength of the apex provide for tightening of the strapping without damaging the article. Moreover, the core 12 prevents the strap from cutting into the article 30 and the interior layers of corrugated provide good cushioning to the edges of the article.

In FIG. 4, there is shown an alternative embodiment where the article is placed in a cardboard or a paperboard container 34 having thin walls. The corner posts 10 occupy the four corners of the container 10 again providing all of the advantages recited above including good stacking strength, good cushioning, good impact resistance and providing substantial offset between the surface of the article and the side walls of the container.

In FIG. 5, the corner posts 10 are placed along the side edges of the article 30 afterwhich the article and posts are enveloped in a plastic film 36 such as by known stretch wrap or shrink wrap techniques. Again, the corner posts provide the desired edge protection to the article.

Figure 6:
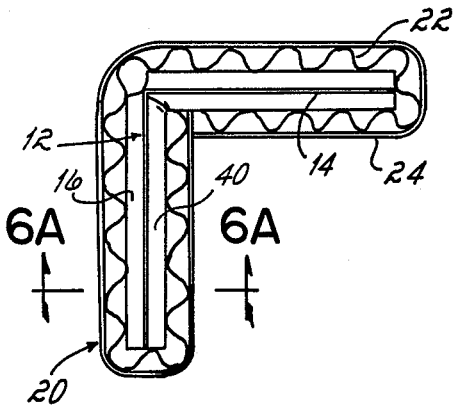
FIG. 6 is a top view of a second form of corner post.
Figure 6A:
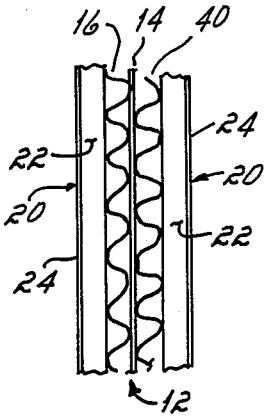
FIG. 6A is a view taken along line 6A—6A of FIG. 6.

Referring now to FIG. 6, in an alternative embodiment, the core 12 is formed with a fluted sheet 16, as in FIG. 2, but in addition with an opposed fluted sheet 40 on the opposite side of the plain sheet 14. The flutes in sheets 16 and 40 run in the same direction, i.e., perpendicular to the long edges 17*a*, 17*b* of the post. The flutes 22 of the outer sheet 20 are thus adhered to the flutes 16 and 40 of the core 12. This provides the post with a core 12 of twice the thickness of that shown in FIG. 2.

Figure 7:
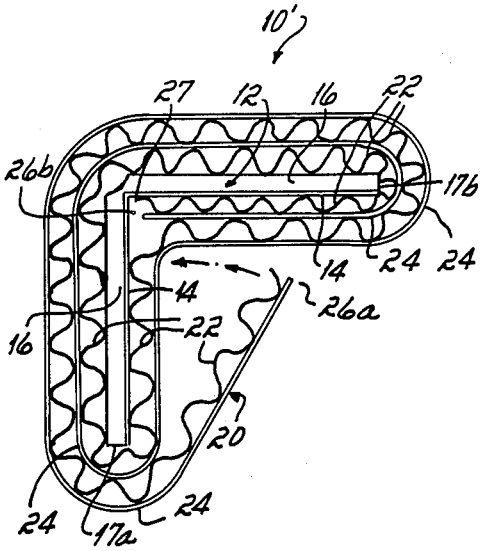
FIG. 7 is a view similar to FIG. 2 showing multiple wraps with the single-faced corrugated cardboard.

Referring now to FIG. 7, in an alternative embodiment, additional wraps of the single face corrugated 20 are made to provide a corner post 10′ having an outer wrapping of multiple layers of the single face corrugated.

As may be seen, the corner post 10 is made of relatively inexpensive materials, i.e., two sheets corrugated paper, is relatively simple in design and is economical to produce. However, the combination of elements results in a combination of highly desirable properties at a relatively low cost.

Thus having described the invention, what is claimed is:

1. An integral, elongated corner post for cushioning and protecting an edge of an article comprising, in combination, a core of a first sheet of single-face corrugated paper, including a first facing sheet and a first corrugated sheet having a pair of lengthwise edges and having a series of aligned flutes perpendicular to said lengthwise edges;

an outer wrapping of at least one layer of a second sheet of single-face corrugated paper completely about said core including said lengthwise edges thereof, said second sheet of single-face corrugated paper including a second facing sheet and a second corrugated sheet having a series of aligned flutes parallel to said lengthwise edges, the flutes of said first corrugated sheet and said second corrugated sheets being perpendicular to each other; and means for adhering the flutes of said second sheet to said core;

said second facing sheet facing outwardly and providing a smooth outer surface of said corner post with rounded lengthwise edges and a rounded apex, said corrugated paper providing cushioning of said edge of said article and impact resistance.

2. An integral, elongated corner post for cushioning and protecting an edge of an article comprising, in combination, a core of a first sheet of single-face corrugated paper, including a first facing sheet and a first corrugated sheet having a pair of lengthwise edges and having a series of aligned flutes perpendicular to said lengthwise edges;

an outer wrapping of multiple layers of a second sheet of single-face corrugated paper completely about said core including said lengthwise edges thereof, said wrapping including alternating layers of a second facing sheet and a second corrugated sheet having a series of aligned flutes parallel to said lengthwise edges, the flutes of said second corrugated sheet contacting said core being adhered on one side to the surfaces of said core and on the other to said second facing sheet and being perpendicular to the flutes of said first corrugated sheet, the remaining flutes being adhered to the facing sheet of the adjacent layer of corrugated paper; and means for adhering the flutes of said second sheet;

the outermost layer of wrapping providing a smooth outer surface of said corner post with rounded lengthwise edges and rounded apex, said corrugated paper providing cushioning of said vertical edge of said article and impact resistance.

3. An integral, elongated corner post for cushioning and protecting an edge of an article comprising, in combination, a core of a first sheet of corrugated paper, including a first facing sheet and first and second corrugated sheets on either side of said first facing sheet, said core having a pair of lengthwise edges and having a series of aligned flutes in said first and second corrugated sheets perpendicular to said lengthwise edges;

an outer wrapping of at least one layer of a second sheet of single-face corrugated paper completely about said core including said lengthwise edges thereof, said second sheet of single-face corrugated paper including a second facing sheet and a corrugated sheet having a series of aligned flutes parallel to said lengthwise edges, the flutes of said first and second corrugated sheets of said core and said second corrugated sheet of said outer wrapping being perpendicular to each other; and means for adhering the flutes of said third corrugated sheet to the flutes of said core;

said second facing sheet facing outwardly and providing a smooth outer surface of said corner post with rounded lengthwise edges and a rounded apex, said corrugated paper providing cushioning of said edge of said article and impact resistance.

4. An integral, elongated corner post for cushioning and protecting an edge of an article comprising, in combination, a core of a first sheet of corrugated paper, including a first facing sheet and first and second corrugated sheets on either side of said first facing sheet, said core having a pair of lengthwise edges and having a series of aligned flutes in said first and second corrugated sheets perpendicular to said lengthwise edges;

an outer wrapping of multiple layers of a second sheet of single-face corrugated paper completely about said core including said lengthwise edges thereof, said wrapping including alternating layers of a second facing sheet and a third corrugated sheet having a series of aligned flutes parallel to said lengthwise edges, the flutes of said third corrugated sheet contacting said core being adhered on one side to the surfaces of said first and second corrugated sheets of said core and on the other to said second facing sheet and being perpendicular to the flutes of said first and second corrugated sheets, the remaining flutes being adhered to the facing sheet of the adjacent layer of corrugated paper; and means for adhering the flutes of said second sheet;

the outermost layer of wrapping providing a smooth outer surface of said corner post with rounded lengthwise edges and rounded apex, said corrugated paper providing cushioning of said edge of said article and impact resistance.

* * * * *